United States Patent [19]

Takenaka et al.

[11] Patent Number: 4,771,214

[45] Date of Patent: Sep. 13, 1988

[54] ELECTRON TUBE PROVIDED WITH POROUS SILICON OXIDE GETTER

[75] Inventors: Shigeo Takenaka; Takeo Itou; Norio Koike; Hidemi Matsuda, all of Fukaya, Japan

[73] Assignee: Kabushiki Kaisha Toshiba, Kawasaki, Japan

[21] Appl. No.: 837,831

[22] Filed: Mar. 10, 1986

[30] Foreign Application Priority Data

Mar. 18, 1985 [JP] Japan ..... 60-52183

[51] Int. Cl.[4] ..... H01J 7/18; H01J 29/88; H01J 29/94

[52] U.S. Cl. ..... 313/479; 313/481; 313/553; 313/558

[58] Field of Search ..... 313/479, 481, 554, 555, 313/558, 559, 553; 417/48, 51; 252/181.1, 181.3, 181.6

[56] References Cited

U.S. PATENT DOCUMENTS

| | | | |
|---|---|---|---|
| 3,792,300 | 2/1974 | Benda et al. | 313/479 X |
| 4,342,662 | 8/1982 | Kimura et al. | 313/481 X |
| 4,559,471 | 12/1985 | Kroontje | 313/562 X |

FOREIGN PATENT DOCUMENTS

| | | |
|---|---|---|
| 55-65286 | 5/1980 | Japan . |
| 59-177833 | 10/1984 | Japan . |

*Primary Examiner*—David K. Moore
*Assistant Examiner*—K. Wieder
*Attorney, Agent, or Firm*—Oblon, Fisher, Spivak, McClelland & Maier

[57] ABSTRACT

Electron tube having an evacuated envelope equipped with an electron emitting cathode, wherein a layer of activated silicon oxide is formed inside the envelope. The activated silicon oxide layer improves the emission life.

19 Claims, 2 Drawing Sheets

ELECTRON TUBE PROVIDED WITH POROUS SILICON OXIDE GETTER

BACKGROUND OF THE INVENTION

This invention relates to an electron tube, more particularly to an electron tube containing within its envelope a substance which improves the emission life of the cathode.

A typical electron tube such as a color cathode ray tube is usually provided with a front panel having phosphor screen on its inner surface, a funnel united with the panel and having conductive film on its inner surface, a neck united with the funnel and housing an electron gun, a shadow mask disposed in close proximity to the phosphor screen, and a magnetic inner shield which is assembled so as to be continuous with the shadow mask and extends along the inside face of the funnel. The phosphor screen comprises a phosphor layer consisting of at least phosphor dots or phosphor stripes emitting red, green and blue light and a metal backing layer formed on this layer. It is generally known also that to continuously maintain the degree of vacuum within the evacuated envelope, a metal getter film is formed on the inner surface of the funnel or the inner surface of the neck. The getter film absorbs the gases generated during operation of a color CRT from the various members described above which together constitute the color cathode ray tube, and thereby maintains the degree of vacuum. Generally speaking, when a color cathode ray tube is operating, there are produced a variety of gases, i.e., gas released from the vicinity of the cathode heater forming part of the electron gun, as a result of the heat from the heater; as released from the electrode members also forming part of the electron gun and from the shadow mask, due to the impinging on them of the electron beam emitted from the electron gun; and gas released as a result of the electron beam which has impinged on the shadow mask etc. being reflected and scattered and then re-impinging on the magnetic inner shield, inner conductive coating etc. Ionized by the beams of electrons which have been accelerated to a high voltage, these gases collide with the cathode surfaces of the abovementioned cathodes, and poison the electron emissive material of these cathode surfaces, thereby adversely affecting their emission characteristics. Further, when the temperature of the cathode surfaces etc. falls as the cathode ray tube is switched off, these gases which were produced during opertion are not only adsorbed on the getter film but are also adsorbed on the cathode surfaces, thereby poisoning the latter, and adversely affecting their emission characteristics. The principal constituents of the gases referred to above are $H_2O$, $CH_4$ or the like. Water glass or sodium silicate is usually mixed with the graphite suspension mentioned earlier in order to strengthen the adhesion of the inner conductive film, of which the graphite suspension is the principal constituent, and this water glass, because of its great hygroscopicity, is a major source of gas production, which, as aforesaid, causes deterioration of the emission characteristics. The needs of construction of the neck diameter which is entailed by enlargement of the deflection angle of a color cathode ray tube, and the reduction in baking temperature in the exhaust process in order to shorten process time, make the deterioration in emission characteristics caused by the discharge gases mentioned above, and hence the reduction in emission life, still more marked. The emission life is a problem not only in color cathode ray tubes, but also in other electron tubes with a cathode, such as monochrome cathode ray tubes, travelling-wave tubes, magnetrons, klystrons, transmitting tubes and the like.

Finally, Japanese patent application Laid-Open No. 59-177833 discloses a technique for using $SiO_2$ as a binder for the graphite conductive film, instead of the normally used water glass; but the function of the $SiO_2$ here is that of a binder only, and it is not suggested that it improves emission.

SUMMARY OF THE INVENTION

It is an object of this invention to provide an electron tube of excellent emission life characteristics, in which the electron emissivity of the electron beam-generating cathode surfaces is not adversely affected by the release of the gases referred to above, and which therefore will maintain the desired tube life characteristics over a long period.

This object is achieved by following construction according to the invention. The invention consists in an electron tube, containing at least an electron-emitting cathode and at least one member with a conductive surface and/or an insulating surface within an evacuated envelope, wherein a layer of activated silicon oxide is formed on a part of the surface.

In one aspect of the invention, a cathode ray tube comprises an envelope comprising a panel, a funnel sealingly united with the panel, and a neck extending on the side opposite to the funnel; a phosphor screen formed on the inside face of the panel; an inner conductive film attached to the inside wall of the funnel and an electron gun for generating an electron beam, mounted at the neck and containing a cathode; wherein a layer of activated silicon oxide is provided on at least part of the inside of the envelope.

By "activated silicon oxide" is meant silicon oxide which will adsorb and control residual gases within the evacuated envelope, in particular those gases with a negative action on cathode emission. This can be produced from organic salts of silicon. It is believed that it adheres to the wall of the evacuated envelope and part of the surface of each of the electrodes, in the form of a porous layer with numerous minute holes to enlarge active surfaces.

The amount of activated silicon oxide is practically from 1 to 50 mg, per liter of volume of the envelope. If it is less than 1 mg, its contribution to prolonging the emission life of the cathodes will be minimal, while its effect is saturated if it exceeds 50 mg.

DETAILED DESCRIPTION OF THE PREFERRED EMBODIMENT

Figure 1:
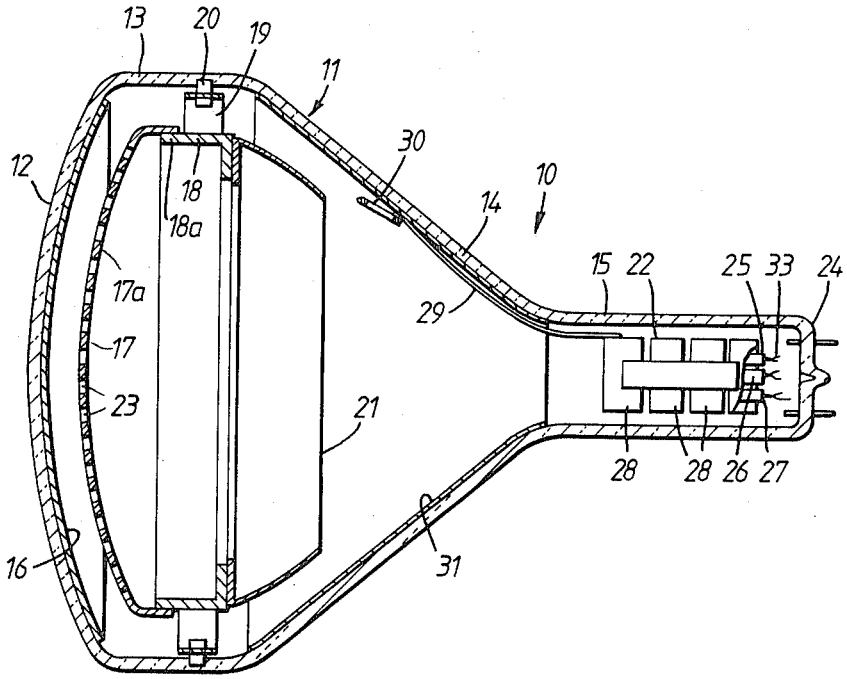
FIG. 1 is a cross-sectional view of an embodiment of the invention.

FIG. 1 shows an embodiment of the invention. The evacuated envelope 11 of color cathode ray tube 10 consists of panel 12 of transparent glass curved into a substantially spherical surface, a funnel 14 of which one end face is sealingly attached to the skirt 13 of this panel 12, and a tubular neck 15 which is integrally attached to the tapered part of the other end of the funnel.

A phosphor screen 16 is formed on the inner surface of panel 12. Screen 16 consists of a phosphor layer made up of successive stripes of phosphor which emit red, green, and blue light respectively, and a metal backing layer of Al coated on to this layer. A shadow mask 17 consisting of a steel plate with numerous slit apertures 23 is disposed facing phosphor screen 16. Shadow mask 17 is supported at its periphery by a mask frame 18, and is demountably fixed by means of resilient supports 19 on support pin 20 anchored in skirt 13 of panel 12. A magnetic inner shield 21, extending on the electron gun side of the mask frame is fixed to mask frame 18.

An electron gun 22 which generates electron beams is disposed inside neck 15. When the tube is operating, the electron beams pass through the apertures 23 in the shadow mask 17 and excite the phosphor layer of screen 16. In more detail, electron gun 22 has three cathodes 25, 26 and 27 on the stem 24 side of neck 15. Electrons are emitted from the cathodes, forming three electron beams, which are accelerated and focussed by electrodes 28. The electron emissive surfaces of the cathodes constitute oxide cathodes of which the principal constituent is BaO.

The internal wall of funnel 14 is covered with an inner conductive coating 31. This coating 31 is formed by coating the inner wall of funnel 14, by means of a spray or the like, with a liquid consisting of sodium silicate as a binding agent mixed with a graphite suspension, and then drying. A barium getter ring container 30, containing barium, is fixed by means of resilient metal element 29 to electron gun 22. This ring container 30 is positioned in the funnel when the electron gun 22 is fixed to the neck. In the final stage of the evacuation process, the getter barium metal is evaporated inside the envelope onto the shadow mask, phosphor screen, etc., to increase the degree of vacuum of the envelope by absorbing residual gases.

The activated $SiO_2$ of this embodiment of the invention will now be described. This activated $SiO_2$ can be formed by using a suspension in an aqueous solution of an organic ammonium silicate.

An example of an aqueous solution of an organic ammonium silicate is an aqueous solution of $SiO_2$-choline. This is formed by dissolving silica powder ($SiO_2$) in an aqueous solution of choline ($[HOCH_2CH_2{+}N(CH)_3]OH^-$). When the abovementioned aqueous solution of $SiO_2$-choline is dried, a continuous thin film of $SiO_2$ is formed, which as described in Japanese patent application Laid-Open No 55-65286 is used to modify the surface of inorganic substances. In this invention, the characteristics of this aqueous solution of $SiO_2$-choline are used to improve the emission life of the cathodes.

The abovementioned aqueous solution of $SiO_2$-choline can be applied to all the members with conductive surfaces or insulating surfaces inside the cathode ray tube that are principally irradiated by electron beams, namely the members forming the screen 16, shadow mask 17, inner shield 21, inner conductive coating 31, internal surface of the neck 15, electron gun 22 and getter support element 29.

In particular, the aqueous solution of $Si0_2$-choline may be used in place of some of the sodium silicate which is conventionally mixed as a binding agent with the graphite suspension in order to reinforce the adhesion of the inner conductive film 31 or the black heat-absorption layer (not shown in the drawing) formed on the metal backing constituting the phosphor screen 16. While the adhesion of the graphite suspension is maintained at the same level as in the conventional process, the activated $SiO_2$ formed by heat treatment enhances the emission life characteristics.

Figure 2:
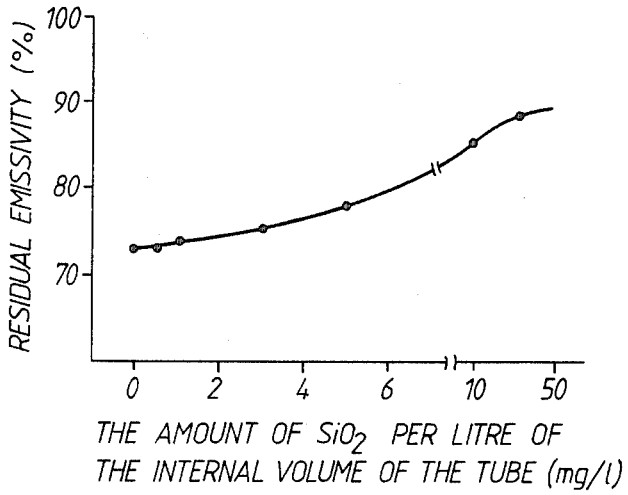
FIG. 2 is a characteristics curve, given in explanation of the effect of the invention showing the relation between the amount of solid activated $SiO_2$ applied inside the envelope and residual emissivity.

There is a strong correlation between the amount of the aqueous solution of $SiO_2$-choline applied and emission life characteristics, and the present inventors discovered, after experiments with various types of oolor cathode ray tube, that emission life characteristics correlate with the solid $SiO_2$ content in the $SiO_2$-choline aqueous solution per unit of the internal volume of the cathode ray tubes. FIG. 2 shows the residual emissivity after a 3000-hour forced emission life test and the solid $SiO_2$ content per liter of the internal volume. As this graph makes clear, a solid $SiO_2$ content of at least 1 mg/l, and preferably at least 5 mg/l, is required in order to secure better residual emissivity than the 70% obtained with conventional color cathode ray tubes. The precise cause of the improvement in cathode ray tube emission life characteristics brought about by the layer of activated $SiO_2$ produced by decomposition of the $SiO_2$-choline aqueous solution is not clear; but the presumption is that it is either the decomposition of a minute amount of a residual ingredient in the $SiO_2$-choline, due to the baking temperature of about 430° C. used during the manufacturing process, or the release, brought about by the energy of the electron beams, of some gas with beneficial properties, which activates the cathodes during operation of the cathode ray tube, or the formation of an $SiO_2$ film with a very large surface area and the adsorption by this film of harmful gases, such as for example oxygen.

The foregoing refers to use of choline as the organic ammonium compound, but quaternary ammonium compounds such as tetramethylammonium hydroxide, and organic ammonium compounds such as tertiary amines, guanidine and the like, and/or silicon alkoxides such as tetramethylortho silicate, tetraethylortho silicate, $Si(OPr^n)_n$ and the like, can be used in this invention in the same way.

Specific embodiments of the invention are described below.

Embodiment 1

A 10% $SiO_2$-choline aqueous solution was prepared by dissolving 10% $SiO_2$ powder in a 10% aqueous solution of choline. The inner conductive coating 31 of funnel 14 was then coated with the 10% $SiO_2$-choline aqueous solution by spraying. During the heat treatment process i.e., baking at about 430 ° C., this aqueous solution decomposed, producing a thin, porous layer of activated silicon oxide. In a 20 in. color cathode ray tube the amount of $SiO_2$ -choline aqueous solution used for the coating was, in terms of solid $SiO_2$ content, approximately 200 mg. In terms of the amount per liter of the internal volume of the 20 in. color cathode ray tube, this is equivalent to approximately 10 mg/l. When three 20 in. color cathode ray tubes manufactured by the usual process were subjected to the 3000-hour forced emission life test, the residual emissivity of the Ba-Ca-O oxide cathode used in the electron gun proved to be 88%, a major improvement over the conventional 73%. Further, the withstand voltage property (evaluated by the number of discharge sparks per minute when a forced acceleration voltage of 30 kV is applied) of these 20 in. color cathode ray tubes after they had been subjected to a prescribed amount of vibration was improved from the conventional figure of 1 to 0.2 (average for 10 cathode ray tubes), while the adhesion of the active film produced by the decomposition of the $SiO_2$-choline aqueous solution was maintained.

Embodiment 2

A coating of a 10% $SiO_2$-choline aqueous solution prepared as in Embodiment 1 was applied by spraying onto conductive surfaces of a shadow mask assembly 17, 18 which had been preheated to approx. 80° C. The amount of the coating used to form activated $SiO_2$ layers 17*a*, 18*a* on the shadow mask assembly of a 20 in. color cathode ray tube, in terms of solid $SiO_2$, was approx. 100 mg, which is equivalent to 5 mg of solid $SiO_2$ per liter of internal volume of the 20 in. color cathode ray tube. The result of the same emission life test that was applied to Embodiment 1 was a figure for residual emissivity of 86%, an improvement similar to that of Embodiment 1. An adsorption area of at least twice the surface area of the underlying shadow mask can be obtained using the activated film obtained in the manner described above. In fact, in this embodiment, a Kr (krypton) adsorption test performed using the BET method showed that the specific surface area of the film produced was 1.1 $m^2/g$. This corresponds to a value of about 30 times the underlying area.

Embodiment 3

In place of the shadow mask assembly of Embodiment 2, a magnetic inner shield 21 was sprayed with 10% $SiO_2$-choline aqueous solution by the same method as in Embodiment 2. The amount of the coating used on the magnetic inner shield of a 20 in. color cathode ray tube, in terms of solid $SiO_2$, was approx. 50 mg, which is equivalent to approx. 2.5 mg per liter of internal volume of the 20 in. color cathode ray tube. The result of the same emission life test that was applied to Embodiment 2 was an improvement in residual emissivity to 82%.

Embodiment 4

An electron gun 22, excluding the cathodes 25, 26 and 27 and the heater 33, was immersed for several seconds in a 10% $SiO_2$-choline aqueous solution, prepared as in Embodiment 1, and then dried by hot air. The amount of the coating used on the electron gun of a 20 in color cathode ray tube, in terms of solid $SiO_2$, was approx. 50 mg, which is equivalent to approx. 2.5 mg per liter of internal volume of the 20 in. color cathode ray tube. The result of the same emission life test that was applied to Embodiment 1 was an improvement in residual emissivity to 82%.

Embodiment 5

A suspension of which the principal constituent was graphite, i.e. the graphite suspension used to form the inner conductive coating 31 of the tube, was prepared but with part of the water glass content of the suspension replaced by $SiO_2$-choline aqueous solution. The eight ratio of solid $SiO_2$ to the total solid content of the suspension was set at 20%. Of this 20%, 4% derived from the $SiO_2$-choline aqueous solution and 16% from the water glass. The internal surface of funnel 14 was coated with this graphite suspension by spraying. The thickness of the film was controlled so that the amount of graphite suspension used in a 20 in. color cathode ray tube, was such that the solid $SiO_2$ deriving from the $SiO_2$-choline aqueous solution was approx. 100 mg for one cathode ray tube, equivalent to approx. 5 mg per liter of internal volume of the 20 in. color cathode ray tube. When 20 in. color cathode ray tubes were manufactured by the usual process, and subjected to the 3000-hour forced emission life test, residual emissivity improved to 89%.

When the specific surface area of the inner conductive film formed by the aforesaid graphite suspension according to this embodiment of the invention was calculated from the amount of $N_2$ adsorbed at low pressure (about $10^{-5}$ Torr) by the BET method, it was found to be 30 $m^2/g$. For comparison, the specific surface area of an inner conductive film formed with a suspension using waterglass only was 6 $m^2/g$. Thus the formation, according this embodiment of the invention, of activated $SiO_2$ resulted in the surface area being increased by a factor of 5 relative to the surface area obtained using waterglass only.

Embodiment 6

10% $SiO_2$ powder was dissolved in a 10% aqueous solution of tetramethylammonium hydroxide. Next, a graphite suspension (not containing any $SiO_2$-choline aqueous solution) was prepared and applied to the inner surface of the funnel to form an inner conductive film. This film was coated with the aforesaid 10% $SiO_2$-tetramethylammonium hydroxide aqueous solution by spraying, as in Embodiment 1. When 20 in. color cathode ray tubes were manufactured in this way and subjected to the 3000-hour emission life test, residual emissivity improved to 88%, as in Embodiment 1.

In the above embodiments, the invention was applied to color cathode ray tubes. The invention can, however, also be applied to cathode ray tubes which do not use a shadow mask, such as monochrome cathode ray tubes, projection cathode ray tubes and the like. Moreover, the application of the $SiO_2$-choline aqueous solution need not be restricted to a single member. The effect of the invention can be obtained, provided the total amount of solid $SiO_2$ applied to the plurality of members of which the inside of a cathode ray tube consists is at least 1 mg per liter of the internal volume of the cathode ray tube.

Embodiment 7

A silicon alkoxide solution, in this embodiment an ethyl silicate solution, was prepared by diluting 10 parts of ethyl silicate, as main constituent, with 90 parts of ethyl alcohol. This silicon alkoxide solution was sprayed onto an inner conductive coating prepared as in Embodiment 6. After drying, the tube was subjected to the envelope sealing process and baking process at 430° C. This resulted in the formation of a film of activated porous $SiO_2$. The amount of the $SiO_2$ was about 150 mg. The residual emission life of a tube manufactured in this way was 88% after a 3000 hour test.

Embodiment 8

Figure 3:
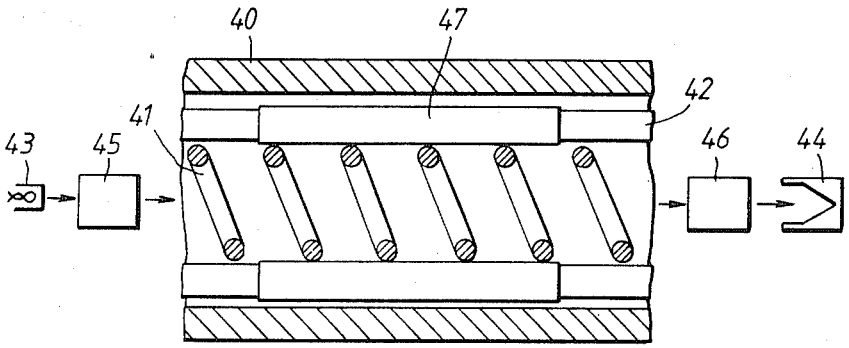
FIG. 3 is a partial cross-sectional view of a further embodiment of the invention.

FIG. 3 depicts an embodiment in which the invention is applied to a traveling-wave tube. A helical delay line is fixed by means of three ceramic support rods 42 about the axis of a tubular evacuated envelope. Microwaves input from an input terminal 45 are amplified in a process in which electrons emitted from electron gun 43 are collected by collecter 44, and the amplified microwaves are output from an output terminal 46. To prevent the microwaves leaking from the output side to the input side, the middle part of each of the ceramic support rods 42 is covered by an attenuator 47. In this embodiment, $SiO_2$-choline solution was mixed in with the attenuation layer when this layer was being applied, resulting in a layer 47 ith an admixture of activated $SiO_2$. Generally speaking, in travelling wave tubes those electrons that have escaped from the narrow electron flow-path impinge on all parts of the inside of the tube, and in doing so generate numerous gases; but the activated $SiO_2$ acts as a getter of harmful gases which would adversely affect the cathodes, and so prevents any deterioration of emission from the cathodes.

The effect of the activated $SiO_2$ can be further enhanced by application of the coating to the inner wall of the envelope, the collector (anode) with a conductive surface, and those parts of the ceramic support rods with insulating surfaces not covered by the attenuators. Moreover, the invention can also be applied to other electron tubes, such as a Klystron, magnetron, or transmitting tube, which use oxide or other cathodes.

As described above, the adoption of the invention makes it possible, by the provision inside the envelope of an electron tube of activated $SiO_2$, to obtain an electron tube, for example a color cathode ray tube, of outstanding emission life characteristics.

We claim:

1. An electron tube comprising at least an electron-emitting cathode and a member with a surface within an evacuated envelope, wherein a porous layer consisting essentially of activated silicon oxide for controlling residual gases is formed on a part of said surface, said porous layer of activated silicon itself acting as an activator.

2. The electron tube according to claim 1, wherein said surface of said member is a conductive surface.

3. The electron tube according to claim 1, wherein said surface of said member is an insulating surface.

4. The electron tube according to claim 1, wherein said activated silicon oxide is the composition product of organic salts of silicon.

5. The electron tube according to claim 4, wherein said organic salts of silicon is selected from the group consisting of silicon organic ammonium salt and silicon alkoxide.

6. An electron tube consisting of a cathode ray tube provided with at least an envelope comprising a panel, a funnel sealingly united with the panel, and a neck extending on the side of the opposite to the funnel; a phosphor screen formed on the inside face of said panel; an inner conductive film attached to the inside wall of the funnel and an electron gun for generating an electron beam, mounted at the neck and containing a cathode; wherein a porous layer consisting essentially of activated silicon oxide is provided on at least part of the inside of said envelope, said porous layer of activated silicon itself acting as an activator.

7. The electron tube according to claim 6, consisting of a color cathode-ray tube in which a shadow mask is provided facing a phosphor screen to which is attached a metal backing layer, and a magnetic inner shield is mounted on the electron gun side of the shadow mask; wherein activated silicon oxide is formed on at least one surface of the inner conductive film, metal backing layer, magnetic shield, shadow mask, and electron gun.

8. The electron tube according to claim 1, wherein the amount of the axtivated silicon oxide contained in the envelope is from 1 mg to 50 mg of silicon oxide per liter of volume of the envelope.

9. The electron tube according to claim 6, wherein the amount of the activated silicon oxide contained in the envelope is from 1 mg to 50 mg of silicon oxide per liter of volume of the envelope.

10. The electron tube according to claim 6, wherein the inner conductive film is formed by a graphite coating using sodium silicate as the binding agent, and activated silicon oxide is admixed with this coating.

11. The electron tube according to claim 7, wherein the inner conductive film is formed by a graphite coating using sodium silicate as the binding agent, and activated silicon oxide is admixed with this coating.

12. The electron tube according to claim 6, wherein the activated silicon oxide is the decomposition product of a silicon organic salt.

13. The electron tube according to claim 12, wherein said organic salts of silicon is selected from the group consisting of silicon organic ammonium salt and silicon alkoxide.

14. The electron tube according to claim 7, wherein the activated silicon oxide is used in conjunction with a metallic getter.

15. The electron tube according to claim 6, wherein the cathode is an oxide cathode.

16. The electron tube according to claim 7, wherein the cathode is an oxide cathode.

17. The electron tube according to claim 1, wherein said activated silicon oxide is coated on said surface impinged by electrons emitted from said cathode.

18. The electron tube according to claim 1, wherein the amount of the activated silicon oxide contained in the envelope is from 5 mg to 50 mg of silicon oxide per liter of volume of the envelope.

19. The electron tube according to claim 6, wherein the amount of the activated silicon oxide contained in the envelope is from 5 mg to 50 mg of silicon oxide per liter of volume of the envelope.

* * * * *